US007701316B2

(12) United States Patent
Teng et al.

(10) Patent No.: US 7,701,316 B2
(45) Date of Patent: Apr. 20, 2010

(54) INTEGRATED MAGNETIC DEVICE

(75) Inventors: Ching-Hsien Teng, Taoyuan Hsien (TW); Kao-Tsai Liao, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/236,722

(22) Filed: Sep. 24, 2008

(65) Prior Publication Data

US 2009/0315661 A1 Dec. 24, 2009

(30) Foreign Application Priority Data

Jun. 18, 2008 (TW) ..... 97122712 A

(51) Int. Cl.

| | |
|---|---|
| ***H01F 21/06*** | (2006.01) |
| ***H01F 27/02*** | (2006.01) |
| ***H01F 27/29*** | (2006.01) |
| ***H01F 27/30*** | (2006.01) |
| ***H01F 5/00*** | (2006.01) |

(52) U.S. Cl. ..... 336/131; 336/90; 336/192; 336/198; 336/200

(58) Field of Classification Search ..... None
See application file for complete search history.

(56) References Cited

U.S. PATENT DOCUMENTS

| | | | | |
|---|---|---|---|---|
| 4,091,349 | A * | 5/1978 | Niederjohn et al. | 336/192 |
| 4,251,911 | A * | 2/1981 | Reynolds et al. | 29/605 |
| 4,258,973 | A * | 3/1981 | Reynolds et al. | 439/392 |
| 4,868,534 | A * | 9/1989 | Pikul | 336/192 |
| 4,999,743 | A * | 3/1991 | Fontana et al. | 361/782 |
| 5,115,560 | A * | 5/1992 | Erb et al. | 29/747 |
| 5,447,455 | A * | 9/1995 | Plosser | 439/863 |
| 6,227,901 | B1 * | 5/2001 | Pupkiewicz et al. | 439/500 |
| 6,480,085 | B2 * | 11/2002 | Chiang et al. | 336/198 |
| 7,498,921 | B1 * | 3/2009 | Wang | 336/200 |
| 2008/0297300 | A1 * | 12/2008 | Ackermann et al. | 336/200 |

* cited by examiner

*Primary Examiner*—Elvin G Enad
*Assistant Examiner*—Mangtin Lian
(74) *Attorney, Agent, or Firm*—Kirton & McConkie; Evan R. Witt

(57) ABSTRACT

An integrated magnetic device disposed on a system circuit board is disclosed. The integrated magnetic device comprises a first magnetic device and a second magnetic device. The first magnetic device comprises a primary winding having at least a terminal; a secondary winding disposed corresponding to the primary winding, a magnetic core assembly assembled with the primary and secondary windings and partially covered by the primary and secondary windings, and a receiving chamber. The second magnetic device has a central through hole and a plurality of conductive ends. The second magnetic device is received in the receiving chamber of the first magnetic device and electrically connected to the system circuit board via the conductive ends, and the terminal of the primary winding of the first magnetic device pierces through the central through hole of the second magnetic device and electrically connects to the system circuit board.

10 Claims, 9 Drawing Sheets

2

4

5

INTEGRATED MAGNETIC DEVICE

FIELD OF THE INVENTION

The present invention relates to an integrated magnetic device, and more particularly to an integrated magnetic device with current sensor therein.

BACKGROUND OF THE INVENTION

Generally speaking, many magnetic devices are disposed in electronic equipment. Transformer is one of the common magnetic devices to regulate voltage by electromagnetic theory, so as to provide suitable voltage for electronic equipment.

Take server circuit for example, the current of the transformer of the circuit is detected by current sensor, such as current transformer. FIG. 1 is a schematic diagram showing the transformer and the current sensor disposed on the system circuit board according to the conventional technique. As shown in FIG. 1, the conventional transformer 10 and the current sensor 11 are separately disposed on the system circuit board 1. The ends of the primary winding are served as terminals 101 of the transformer 10, and the ends of the winding of the current sensor 11 are served as conductive ends 111. The terminals 101 and the conductive ends 111 are soldered to the predetermined position of the system circuit board 1, respectively. The current sensor 11 comprises a central through hole 110 at the center thereof and a conductive wire 112 piercing through the central through hole 110 and being soldered to the system circuit board 1. One of the terminals 101 of the primary winding of the transformer 10 and the conductive wire 112 of the current sensor 11 are electrically connected to each other through the trace (not shown) of the system circuit board 1. Therefore, current of the transformer 10 can be transformed by the current sensor 11 and measured by suitable instrument.

However, since the transformer 10 and the current sensor 11 are separately disposed on the system circuit board 1, certain amount of space on the system circuit board 1 is occupied. Thus fragmentary space on the system circuit board 1 is formed, and the trend for minimizing the volume of the electronic equipment cannot be matched. In addition, since the transformer 10 and the conductive wire 112 of the current sensor 11 are electrically connected via the trace of the system circuit board 1, the assembly procedure is inconvenient and power loss is easily caused.

Accordingly, it is required to develop an integrated magnetic device to overcome the foregoing defects.

SUMMARY OF THE INVENTION

An object of the present invention is to provide an integrated magnetic device, wherein the current sensor is disposed on the transformer, so as to integrate the current sensor and the transformer as an integrated magnetic device. In addition, the terminal of the primary winding of the transformer directly pierces through the central through hole of the current sensor. Accordingly, the waste of space and the power loss caused by respectively disposing the transformer and the current sensor on the system circuit board can be prevented. Since the space utility of the system circuit board and the efficiency of the integrated magnetic device can be improved, the volume of the electronic equipment having the integrated magnetic device therein can be reduced, and the efficiency thereof can be raised as well.

According to an aspect of the present invention, an integrated magnetic device is provided. The integrated magnetic device is disposed on a system circuit board and comprises: a first magnetic device comprising: a primary winding having at least a terminal; a secondary winding disposed corresponding to the primary winding; a magnetic core assembly assembled with the primary winding and the secondary winding and partially covered by the primary winding and the secondary winding; and a receiving chamber; and a second magnetic device having a central through hole and a plurality of conductive ends, the second magnetic device being received in the receiving chamber of the first magnetic device and electrically connected to the system circuit board via the conductive ends, and the terminal of the primary winding of the first magnetic device piercing through the central through hole of the second magnetic device and being electrically connected to the system circuit board.

In an embodiment, the first magnetic device further comprises a bobbin, and the bobbin comprises: a main body having a sidewall at opposite side thereof; and a channel penetrating through the sidewall and the main body, so as to receive part of the magnetic core assembly.

In an embodiment, a winding section is defined by the main body and the sidewall of the bobbin of the first magnetic device, and the primary and secondary windings are conductive wires disposed on the winding section.

In an embodiment, the bobbin of the first magnetic device further comprises a first extension portion, the first extension portion being extended from the sidewall and having a plurality of conductive pins disposed thereon, so as to dispose the integrated magnetic device on the system circuit board via the conductive pins.

In an embodiment, the receiving chamber of the first magnetic device is disposed in the first extension portion of the bobbin.

In an embodiment, the first extension portion of the bobbin of the first magnetic device further comprises: a first through portion and a second through portion corresponded to the central through hole of the second magnetic device and communicated with the receiving chamber, the terminal of the primary winding piercing through the second through portion, the central through hole of the second magnetic device, and the first through portion and electrically connecting to the system circuit board; and a plurality of recesses disposed at the edge of the receiving chamber, so as to guide the conductive ends of the second magnetic device to electrically connect with the conductive pins adjacent thereto.

In an embodiment, the bobbin of the first magnetic device further comprises a second extension portion being extended from the sidewall and opposite to the first extension portion.

In an embodiment, the receiving chamber of the first magnetic device is disposed in the second extension portion of the bobbin.

In an embodiment, the second extension portion of the bobbin of the first magnetic device further comprises: a first through portion and a second through portion corresponded to the central through hole of the second magnetic device and communicated with the receiving chamber, the terminal of the primary winding piercing through the second through portion, the central through hole of said second magnetic device, and the first through portion and electrically connecting to the system circuit board; and a plurality of third through portions communicated with the receiving chamber, the conductive ends of the second magnetic device being partially received in the third through portions.

In an embodiment, the bobbin of the first magnetic device further comprises a plurality of partitions disposed on the main body, at least a winding section is defined by the partitions, the sidewall and the main body, and a receiving portion is defined by the partitions and partially communicated with the channel.

In an embodiment, the primary winding of the first magnetic device is conductive wire disposed on the winding section of the bobbin, the secondary winding is a plurality of conductive pieces being disposed at the opposite sides of the bobbin and received in the receiving portion, so as to dispose the integrated magnetic device on the system circuit board through the secondary winding.

In an embodiment, the receiving chamber of the first magnetic device is disposed on the sidewall of the bobbin.

In an embodiment, the receiving chamber of the first magnetic device further comprises: a first through portion corresponded to the central through hole of the second magnetic device, the terminal of the primary winding piercing through the central through hole of the second magnetic device and the first through portion and electrically connecting to the system circuit board; and at least a second through portion, the conductive ends of the second magnetic device piercing through the second through portion and electrically connecting to the system circuit board.

In an embodiment, the first magnetic device further comprises a cover, the cover is disposed on the magnetic core assembly, and the receiving chamber is disposed on the cover.

In an embodiment, the receiving chamber of the first magnetic device further comprises: a first through portion corresponded to the central through hole of the second magnetic device, the terminal of the primary winding piercing through the central through hole of the second magnetic device and the first through portion and electrically connecting to the system circuit board; and at least a second through portion, the conductive ends of the second magnetic device piercing through the second through portion and electrically connecting to the system circuit board.

In an embodiment, the magnetic core assembly comprises a first magnetic portion and a second magnetic portion, the first magnetic portion is received in the channel of the bobbin of the first magnetic device, and the second magnetic portion is covered on the primary and secondary windings.

In an embodiment, the first magnetic device is a transformer, and the second magnetic device is a current sensor.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
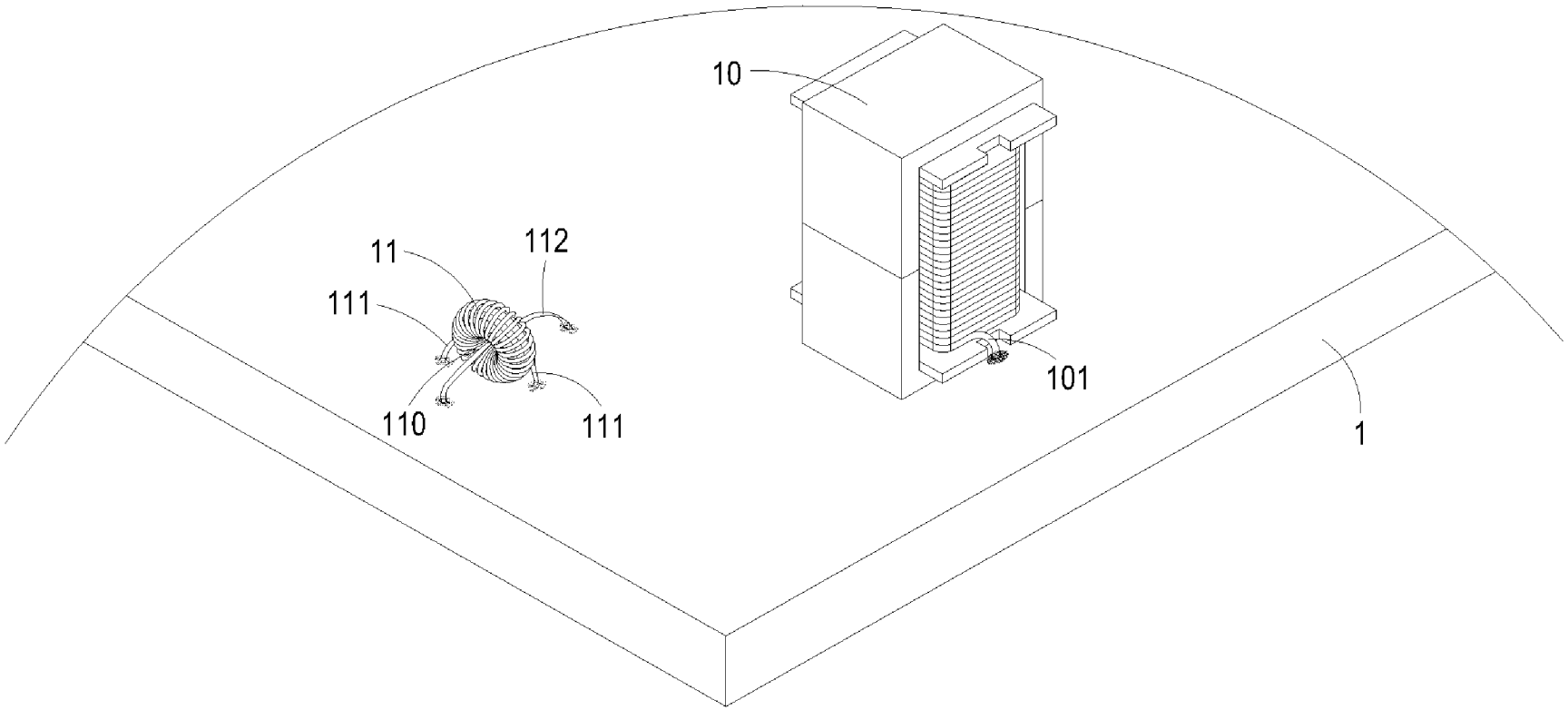
FIG. 1 PRIOR ART
FIG. 1 is a schematic diagram showing the transformer and the current sensor disposed on the system circuit board according to the conventional technique.
Figure 2:
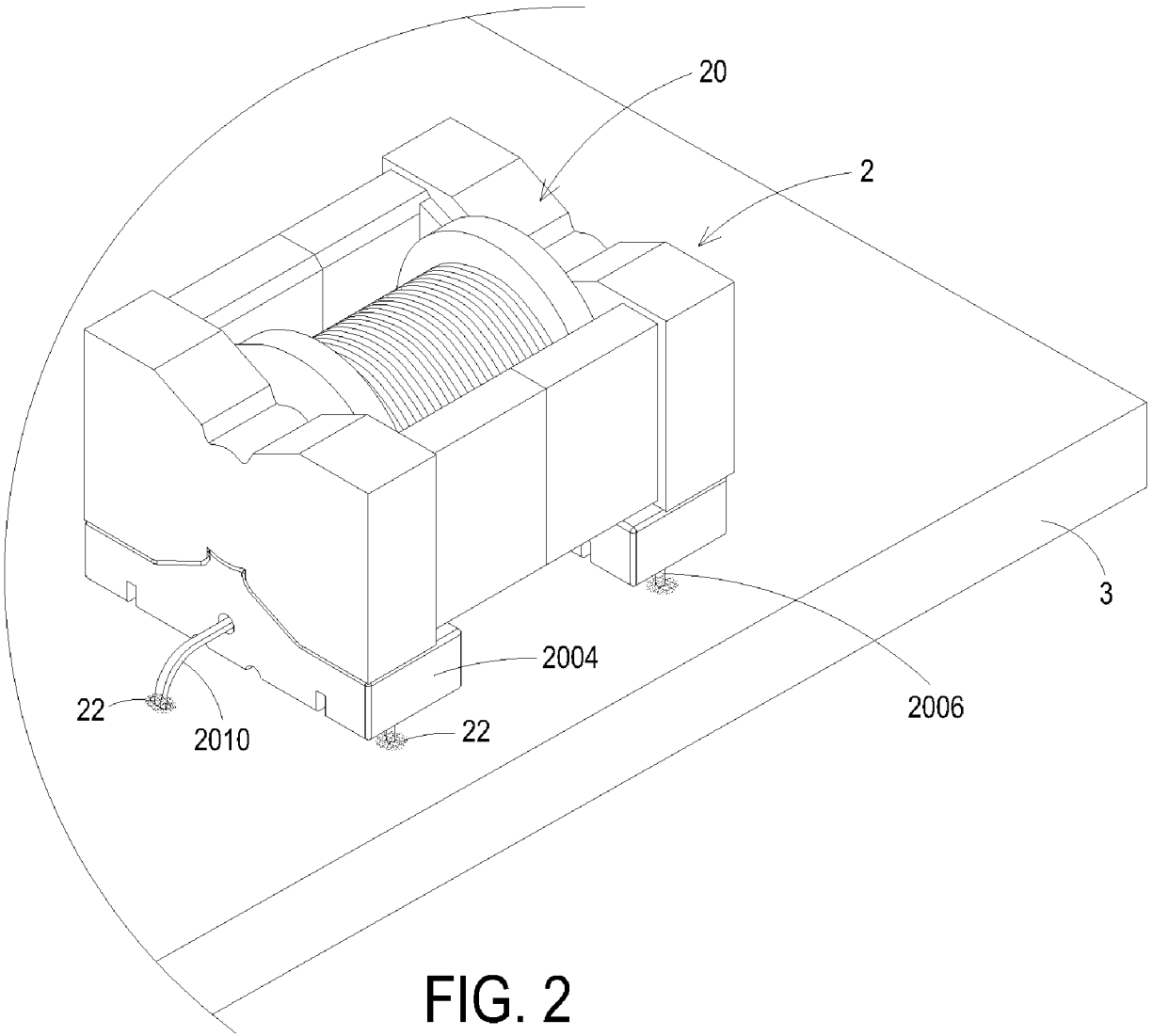
FIG. 2 is a schematic diagram showing the structure of the integrated magnetic device according to the first preferred embodiment of the present invention.
Figure 3:
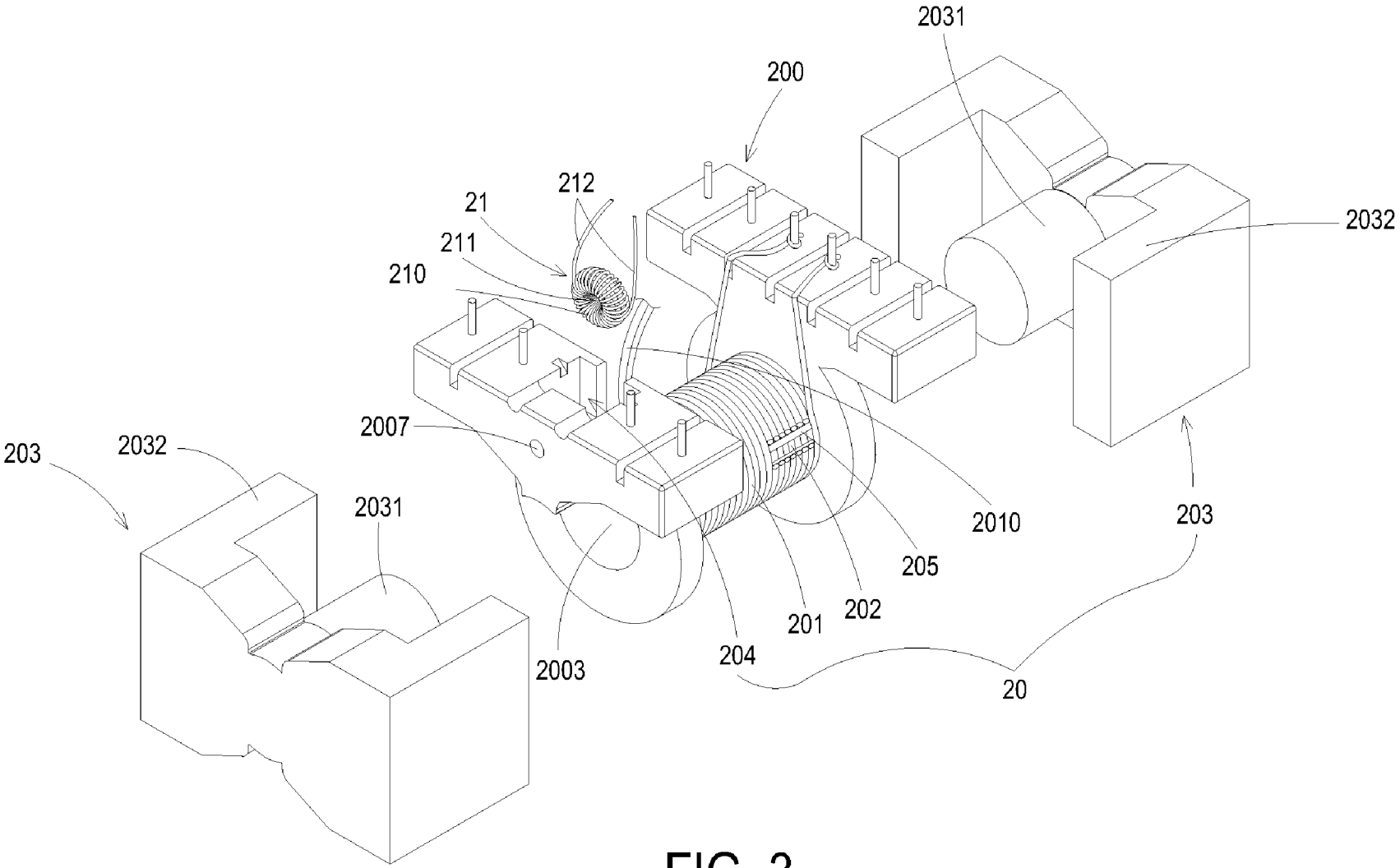
FIG. 3 is a bottom explosion view showing the integrated magnetic device of FIG. 2.
Figure 5:
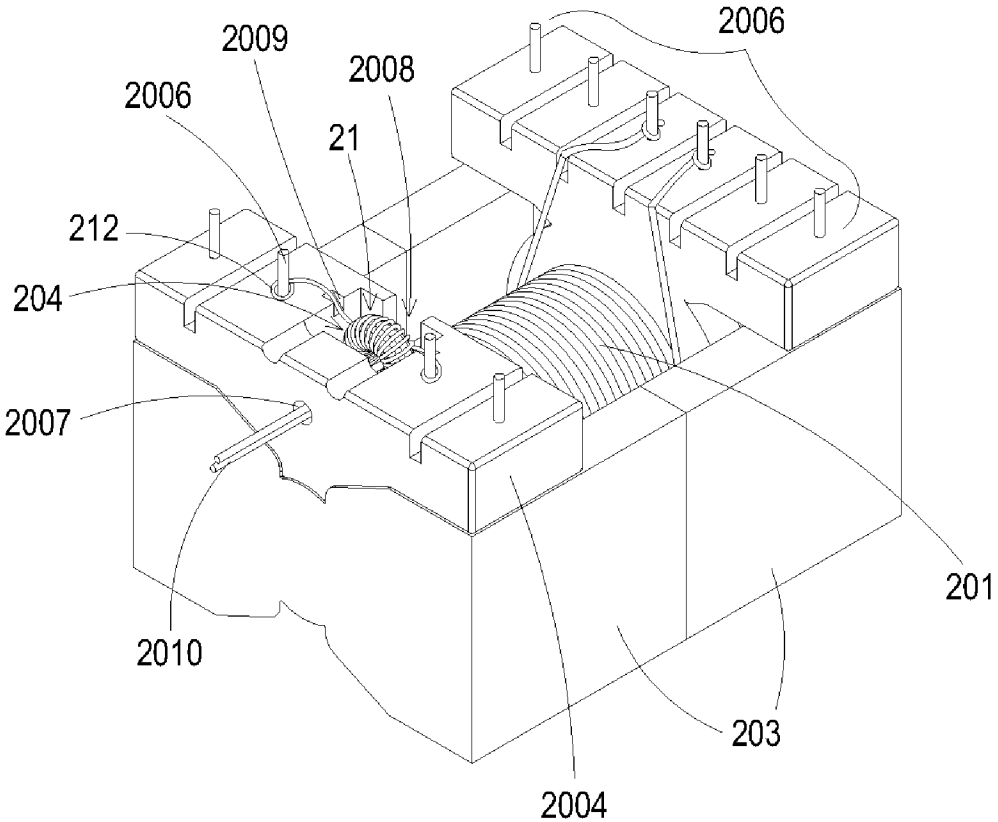
FIG. 5 is a schematic view showing the integrated magnetic device of FIG. 3 being assembled.

Please refer to FIG. 2, which is a schematic diagram showing the structure of the integrated magnetic device according to the first preferred embodiment of the present invention. As shown in FIG. 2, the integrated magnetic device 2 can be disposed on the system circuit board 3 of an electronic apparatus, electronic system or device, such as a server, but not limit thereto. The integrated magnetic device 2 comprises a first magnetic device 20 and a second magnetic device 21 (as shown in FIGS. 3 and 5). The second magnetic device 21 is formed by conductive wire 210 wound on an annular-like magnetic core and has a central through hole 211, wherein two ends of the conductive wire 210 serve as the conductive ends 212 thereof (as shown in FIG. 3). In this embodiment, the second magnetic device 21 is a current sensor, such as a current transformer, applied to detect the electric current of first magnetic device 20, and the first magnetic device 20 can be a transformer, but not limit thereto.

Figure 4:
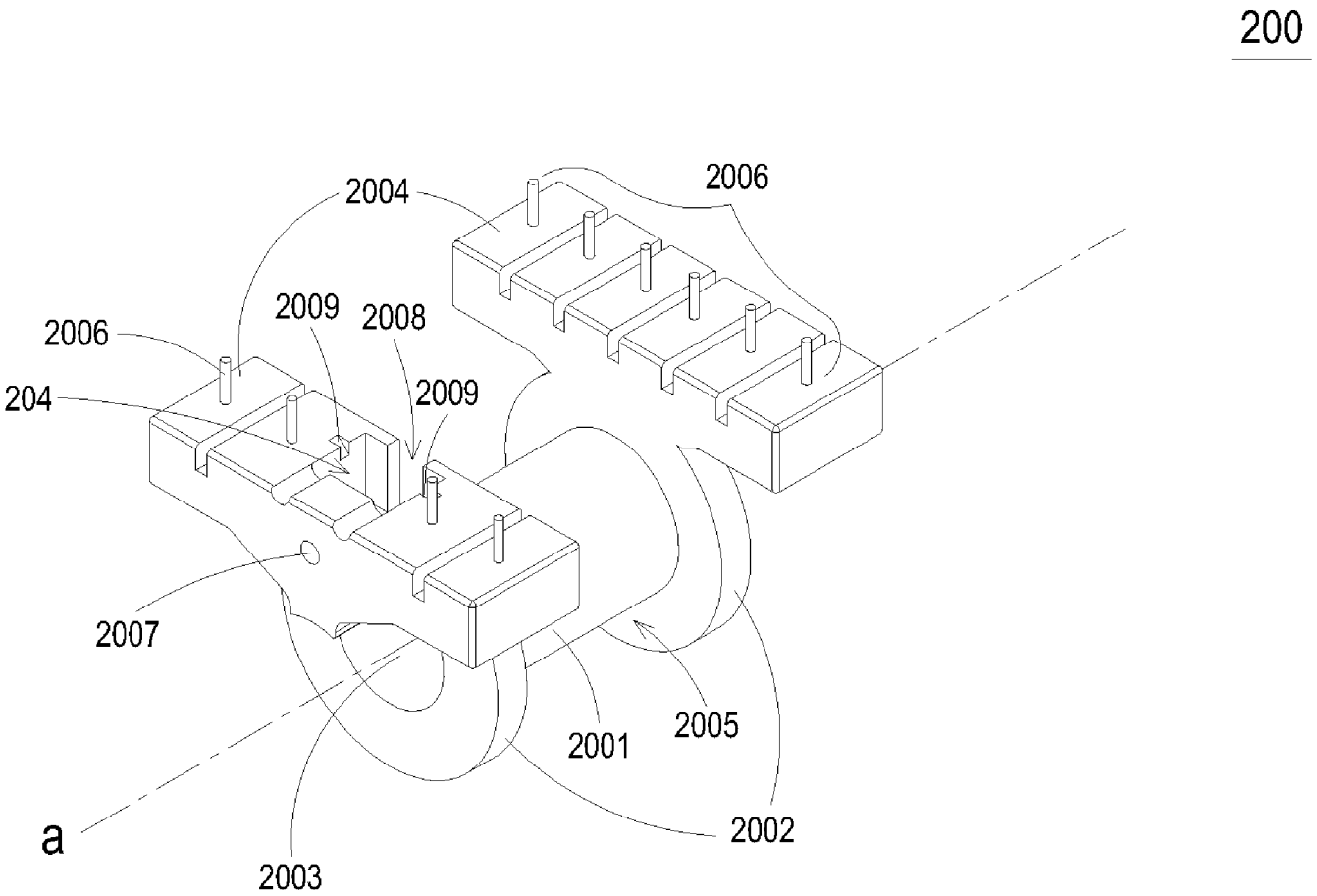
FIG. 4 is a schematic diagram showing the structure of the bobbin of the first magnetic device depicted in FIG. 3.

FIG. 3 is a bottom explosion view showing the integrated magnetic device of FIG. 2, and FIG. 4 is a schematic diagram showing the structure of the bobbin of the first magnetic device depicted in FIG. 3. As shown in FIG. 3, the first magnetic device 20 comprises a primary winding 201, a secondary winding 202, a magnetic core assembly 203, and a receiving chamber 204. In this embodiment, the first magnetic device 20 further comprises a bobbin 200. The primary winding 201 and the secondary winding 202 can be conductive wires, such as enamelled wires, wound on the bobbin 200. The bobbin 200 can be integrally formed by plastic materials, and the bobbin 200 comprises structures of main body 2001, sidewall 2002, and channel 2003 (as shown in FIG. 4). The main body 2001 is preferred to be a rod-like structure with sidewalls 2002 disposed at two opposite sides thereof, so as to define a winding section 2005 by the sidewalls 2002 and the main body 2001 for the conductive wires of the primary and secondary windings 201 and 202 to be wound thereon (as shown in FIG. 3). The channel 2003 penetrates through the sidewalls 2002 and main body 2001 along the axis a of the main body 2001; therefore, the bobbin 200 is substantially a hollow, rod like structure. In this embodiment, the main body 2001, the sidewalls 2002, and the channel 2003 of bobbin 200 can be circular shape, but the shape thereof are unlimited. In addition, the bobbin 200 further comprises first extension portions 2004, each of which is a base extended from the edge of sidewall 2002. A plurality of conductive pins 2006 are disposed on the bottom side of each first extension portion 2004, wherein the conductive pins 2006 are composed of conductive materials. Thus the integrated magnetic device 2 can be disposed on the system circuit board 3 by conductive pins 2006 (as shown in FIG. 2).

Please refer to FIG. 4 again. In this embodiment, the receiving chamber 204 of the first magnetic device 20 is disposed in one of the first extension portions 2004 of the bobbin 200. In other words, the receiving chamber 204 is a receptacle buried in the first extension portion 2004. Preferably, the receiving chamber 204 and the first extension portion 2004 are integrally formed. For example, a receptacle with an opening at the bottom of the first extension portion 2004 can be preserved at the first extension portion 2004 to serve as the receiving chamber 204 of the first magnetic device 20 while fabricating the bobbin 200 of integrally formed structure by plastic material. The depth and length of the receiving chamber 204 is substantially equal to or greater than the outer diameter of the second magnetic device 21, where the width of the receiving chamber 204 is substantially equal to or greater than the thickness of the second magnetic device 21. Therefore, the second magnetic device 21 can be received in the receiving chamber 204 of the first magnetic device 20, so as to install the second magnetic device 21 into the first extension portion 2004 of the bobbin 200 of the first magnetic device 20 and integrate the first and second magnetic devices 20 and 21 as an unitary integrated magnetic device 2 (as shown in FIG. 5).

Please refer to FIG. 4. The first extension portion 2004 having the receiving chamber 204 therewith further comprises a first through portion 2007 and a second through portion 2008, wherein the first through portion 2007 and the second through portion 2008 are located at the opposite sides of the first extension portion 2004 and communicated with the receiving chamber 204. The first through portion 2007 and the second through portion 2008 are corresponded to the central through hole 211 of the second magnetic device 21. In this embodiment, the first through portion 2007 can be a circular through hole, wherein the diameter thereof is substantially greater than or equal to the wire diameter of the terminal 2010 of the primary winding 201 of the first magnetic device 20. The second through portion 2008 is preferred to be an indentation extended to the bottom side of the first extension portion 2004. Thus the terminal 2010 of the primary winding 201 can be guided by the first and second through portions 2007 and 2008. In addition, a plurality of recesses 2009 can be disposed at the edge of the receiving chamber 204 of the first extension portion 2004. In this embodiment, the number of the recess 2009 is preferred to be two, but not limited, so as to cooperate with the conductive ends 212 of the second magnetic device 21. Therefore, when the second magnetic device 21 is received in the receiving chamber 204, the conductive ends 212 of the second magnetic device 21 can be guided by the recesses 2009 for electrically connecting with the adjacent conductive pins 2006 of the first extension portion 2004 of the bobbin 200 of the first magnetic device 20 (as shown in FIG. 5).

Please refer to FIG. 3 and FIG. 5, wherein FIG. 5 is a schematic view showing the integrated magnetic device of FIG. 3 being assembled. While assembling the first magnetic device 20, the primary winding 201 and the secondary winding 202 of the first magnetic device 20 are overlappingly disposed on the winding section 2005 of the bobbin 200. For example, sandwich winding method can be applied for winding the primary and secondary windings 201 and 202, which means half of the primary winding 201 can be wound on the winding section 2005 of the bobbin 200, the secondary winding 202 is overlaid on the primary winding 201 correspondingly, and the rest of the primary winding 201 can be wound on the secondary winding 202 for placing the secondary winding 202 inbetween the primary winding 201. An insulating medium 205, such as insulating tape, can be disposed between the primary winding 201 and the secondary winding 202 in order to isolate the primary winding 201 and the secondary winding 202. After the primary winding 201 and the secondary winding 202 are wound on the bobbin 200, a conductive wire end is preserved to serve as terminal 2010 of the primary winding 201 for assembling with the second magnetic device 21. As regards the rest terminals of the primary winding 201 and the secondary winding 202 can be wound or soldered on the corresponded conductive pins 2006 of the first extension portion 2004 of the bobbin 200 of the first magnetic device 20. Therefore, the primary and secondary windings 201 and 202 can be disposed on the bobbin 200. In FIG. 3, parts of the outmost layer of the primary winding 201 is cut for clearly illustrating the relationship between the primary winding 201 and the secondary winding 202.

In this embodiment, the magnetic core assembly 203 of the first magnetic device 20 can be an EE core assembly, but not limited thereto. The magnetic core assembly 203 comprises a first magnetic portion 2031 and a second magnetic portion 2032, wherein the shape of the first magnetic portion 2031 is substantially the same as that of the channel 2003 of the bobbin 200 of the first magnetic device 20. The outer diameter of the first magnetic portion 2031 is substantially smaller than or equal to the internal diameter of the channel 2003, so the first magnetic portion 2031 of the magnetic core assembly 203 can pierce through and being received in the channel 2003. Accordingly, the first magnetic portion 2031 is covered by the primary winding 201 and the secondary winding 202, where the second magnetic portion 2032 encircles the bobbin 200 and covers parts of the primary and secondary windings 201 and 202, so as to form the first magnetic device 20.

Please refer to FIG. 3 and FIG. 5, while the second magnetic device 21 is assembled with the first magnetic device 20 to form the integrated magnetic device 2, the second magnetic device 21 is received in the receiving chamber 204 of the first magnetic device 20, and the conductive ends 212 thereof are wound or soldered on the adjacent conductive pins 2006 of the first magnetic device 20 under the guidance of the recesses 2009 in order to electrically connect to the conductive pins 2006. Besides, since the central through hole 211 of the second magnetic device 21 is corresponded to the first through portion 2007 and the second through portion 2008 of the first extension portion 2004 of the bobbin 200 of the first magnetic device 20, the terminal 2010 of the primary winding 201 of the first magnetic device 20 can pierce through the second through portion 2008, the central through hole 211 of the second magnetic device 21, and the first through portion 2007 successively and protrude relative from the first extension portion 2004 of the bobbin 200 (as shown in FIG. 5). Of course, in some other embodiments, the adhesive medium (not shown) can be selectively applied to adhere the second magnetic device 21 in the receiving chamber 204 of the first magnetic device 20, so as to prevent the second magnetic device 21 from departing from the receiving chamber 204.

Please refer to FIG. 5 and FIG. 2, the assembled integrated magnetic device 2 is disposed on the system circuit board 3 by soldering the conductive pins 2006 of the first extension portion 2004 of the bobbin 200 of the first magnetic device 20 to the predetermined position of the system circuit board 3 via solder 22. Therefore, the terminals of the primary winding 201 and the secondary winding 202 of the first magnetic device 20 and the conductive ends 212 of the second magnetic device 21 connected to the conductive pins 2006 can be further electrically connected to the system circuit board 3. The terminal 2010 of the primary winding 201 of the first magnetic device 20 that protruded from the first extension portion 2004 can be directly soldered to the predetermined position on the system circuit board 3 via solder 22, so as to electrically connect to the system circuit board 3. While the current applied by the system circuit board 3 is received by the primary winding 201 of the first magnetic device 20, the inductive voltage can be generated by the secondary winding 202 base on electromagnetic theory and transferred to the load (not shown). In addition, since the terminal 2010 of the primary winding 201 pierces through the central through hole 211 of the second magnetic device 21, the current of the first magnetic device 20 can be detected by the second magnetic device 21 base on electromagnetic theory.

Accordingly, it is to be understood that the first and second magnetic device 20 and 21 can be integrated as an integrated magnetic device 2 by receiving the second magnetic device 21 in the receiving chamber 204 of the first magnetic device 20, so as to avoid the waste of space caused by separately disposing the first and second magnetic devices 20, 21 on the system circuit board 3. Therefore, the space utility of the system circuit board 3 can be raised. Moreover, the terminal 2010 of the primary winding 201 of the first magnetic device 20 can pierce through the central through hole 211 of the second magnetic device 21 and electrically connect to the system circuit board 3 directly, so as to improve the inconvenience caused by connecting the transformer 10 and the conductive wire 112 of the current sensor 11 via the trace of the system circuit board 1 and prevent the power loss caused thereby.

Figure 6:
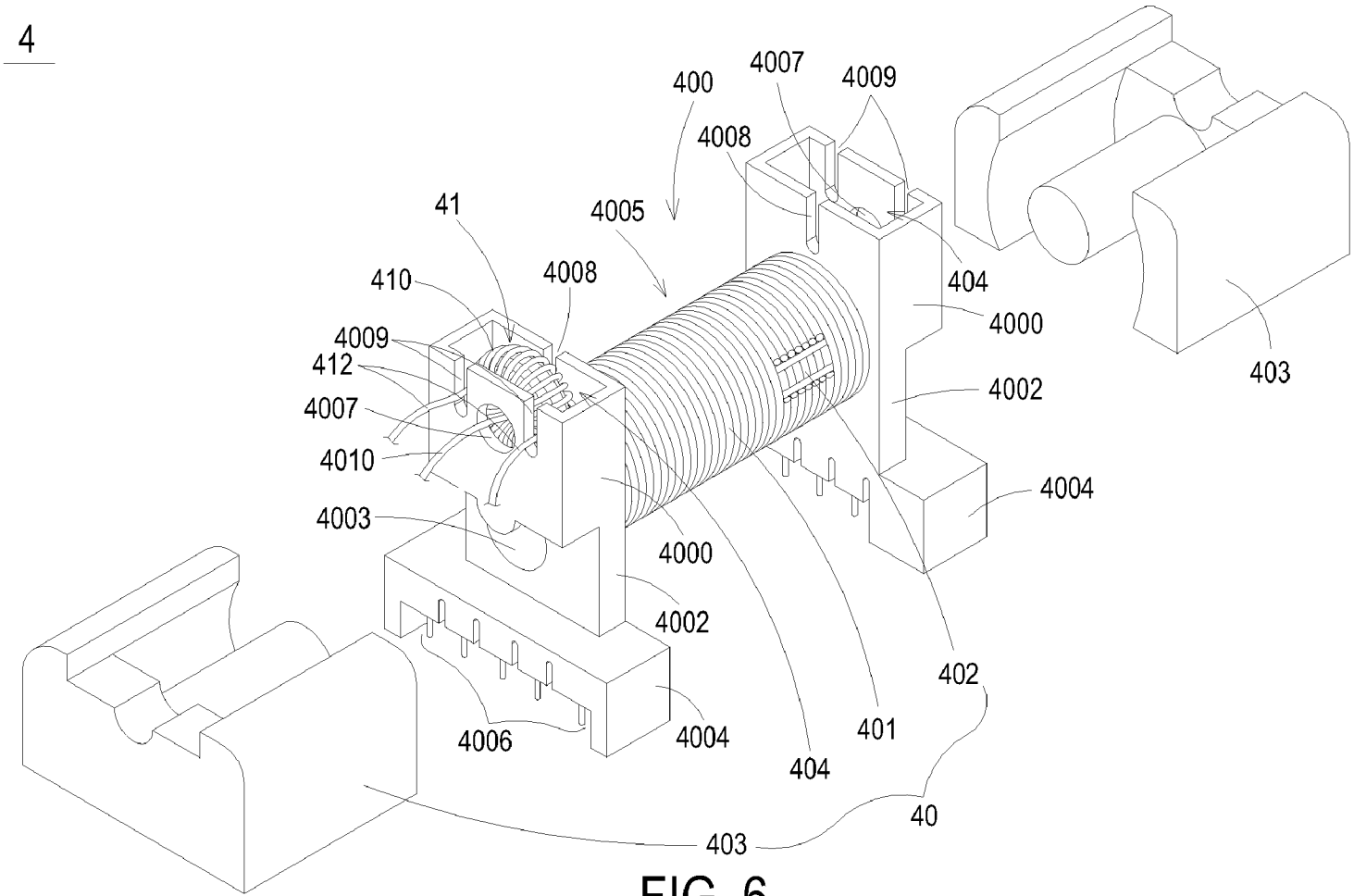
FIG. 6 is a schematic diagram showing the structure of the integrated magnetic device according to the second preferred embodiment of the present invention.

Of course, the present invention is not limited to the foregoing embodiments. Please refer to FIG. 6, which is a schematic diagram showing the structure of the integrated magnetic device according to the second preferred embodiment of the present invention. As shown in FIG. 6, the integrated magnetic device 4 comprises a first magnetic device 40 and a second magnetic device 41, wherein the first magnetic device 40 can be a transformer and the second magnetic device 41 can be a current sensor, such as a current transformer, but not limited thereto. The structure of the second magnetic device 41 is similar to that of the second magnetic device 21 depicted in FIG. 3, which is formed by a magnetic core wound with a conductive wire 410. The second magnetic device 41 comprises a central through hole (not shown) and a plurality of conductive ends 412, for example: two conductive ends 412. The first magnetic device 40 comprises a primary winding 401, a secondary winding 402, a magnetic core assembly 403 and a receiving chamber 404. In this embodiment, the first magnetic device 40 also comprises a bobbin 400. Though the configuration of the bobbin 400 is a little different from that of the bobbin 200 of the first embodiment shown in FIG. 4, the bobbin 400 also comprises a main body, the sidewalls 4002 disposed at the opposite sides of the main body, the channel 4003 piercing through the sidewalls 4002 and the main body, and the first extension portion 4004 extended downwardly from the sidewalls 4002. Similarly, the winding section 4005 is defined by the main body and the sidewalls 4002, and the conductive pins 4006 are extended form the bottom side of the first extension portion 4004. In addition, the primary winding 401 and the secondary winding 402 of the first magnetic device 40 are conductive wires, wherein the relationships among the primary winding 401, the secondary winding 402, the bobbin 400, and the magnetic core assembly 403 are the same as that of the first preferred embodiment, and thus it is not redundantly described here.

Please refer to FIG. 6 again. In this embodiment, the bobbin 400 of the first magnetic device 40 further comprises a second extension portion 4000. The second extension portion 4000 is extended from the sidewalls 4002 toward the direction opposite to where the first extension portion 4004 is disposed, and the receiving chamber 404 of the first magnetic device 40 is disposed in the second extension portion 4000 of the bobbin 400 in this embodiment. In other words, the second magnetic device 41 is carried by the receiving chamber 404 disposed in the second extension portion 4000 of the bobbin 400 of the first magnetic device 40, so as to dispose the second magnetic device 41 on the first magnetic device 40. Besides, since the number of the second extension portion 4000 of the bobbin 400 of the first magnetic device 40 is not limited, which is preferred to be two, and the receiving chamber 404 can be disposed in both of the second extension portions 4000, the second magnetic device 41 can be received in one of the receiving chambers 404 according to the disposition of the integrated magnetic device on the system circuit board (not shown). Each of the second extension portion 4000 of the bobbin 400 of the first magnetic device 40 has not only a first through portion 4007 and a second through portion 4008 corresponded to the central through hole of the second magnetic device 41, but also a plurality of third through portions 4009. In this embodiment, the first through portion 4007 and the second through portion 4008 are respectively a circular through hole and an indentation communicated with the receiving chamber 404. The structures and the functions of the first through portion 4007 and the second through portion 4008 are similar to that of the first and second through portion 2007 and 2008 shown in FIG. 4. Each of the third through portions 4009 is communicated with the receiving chamber 404 as well. The number of the third through portion 4009 is preferred to be two, which are respectively disposed at the opposite sides of the first through portion 4007. The shape of the third through portion 4009 is similar to that of the second through portion 4008, which is an indention indented from the top edge of second extension portion 4000, so as to cooperate with the conductive ends 412 of the second magnetic device 41. However, it is to be understood that the number of the third through portion 4009 is not limited.

Please refer to FIG. 6, in this embodiment, the second magnetic device 41 can be received in the receiving chamber 404 disposed in the second extension portion 4000 of the bobbin 400 of the first magnetic device 40. The conductive ends 412 of the second magnetic device 41 pierce through the third through portion 4009 and partially received therein, so as to position the conductive ends 412 and guide the conductive ends 412 for electrically connecting to the system circuit board (not shown) by the third through portion 4009. In addition, because the central through hole of the second magnetic device 41 is corresponded to the first through portion 4007 and second through portion 4008 of the second extension portion 4000, the terminal 4010 of the primary winding 401 of the assembled first magnetic device 40 can pierce through the second through portion 4008 of the second extension portion 4000, the central through hole of the second magnetic device 41, and the first through portion 4007 of the second extension portion 4000 successively, so as to electrically connect to the system circuit board (not shown) directly. The integrated magnetic device 4 can be structurally and electrically connected to the system circuit board (not shown) via the conductive pins 4006. The relationships between the first and second magnetic devices 40 and 41 are the same as that of the first preferred embodiment shown in FIGS. 3 and 5, and thus they are not redundantly described. Accordingly, it is to be understood that even the receiving chamber 404 is disposed in the second extension portion 4000 of the bobbin 400 of the first magnetic device 40, the purpose for saving the space of the system circuit board can be achieved by receiving the second magnetic device 41 in the receiving chamber 404 disposed in the second extension portion 4000. Moreover, since the terminal 4010 of the primary winding 401 of the first magnetic device 40 pierces through the central through hole of the second magnetic device 41 and electrically connects to the system circuit board directly, the power loss can be effectively reduced.

Figure 7:
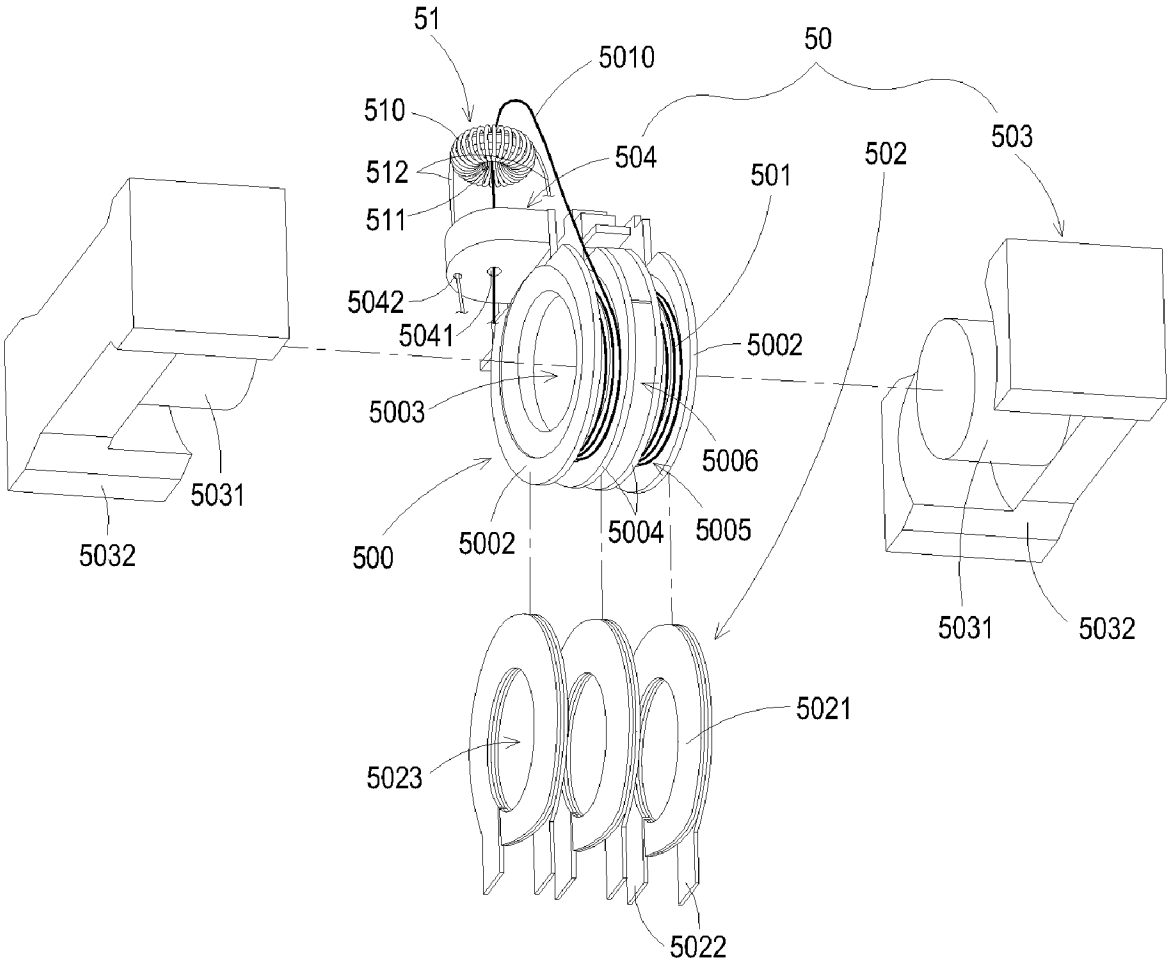
FIG. 7 is an explosion view showing the integrated magnetic device according to the third preferred embodiment of the present invention.

Please refer to FIG. 7, which is an explosion view showing the integrated magnetic device according to the third preferred embodiment of the present invention. As shown in FIG. 7, the integrated magnetic device 5 comprises a first magnetic device 50 and a second magnetic device 51. The second magnetic device 51 can be a current sensor, such as a current transformer, and the conductive wire 510, central through hole 511, conductive ends 512 and the relationships thereof are similar to that of the foregoing embodiments. The first magnetic device 50 is a transformer, but not limited thereto. In this embodiment, the first magnetic device 50 comprises a primary winding 501, a secondary winding 502, a magnetic core assembly 503 and a receiving chamber 504. In addition, the first magnetic device 50 further comprises a bobbin 500. The bobbin 500 has a main body, the sidewalls 5002 disposed at the opposite sides of the main body, and a channel 5003 piercing through the sidewalls 5002 and the main body, wherein the relationships thereof are the same as that of the first and second embodiments shown in FIGS. 4 and 6 as well. However, in this embodiment, the bobbin 500 does not comprise the first and second extension portions but has plural partitions 5004. The partitions 5004 are disposed on the main body and between the two sidewalls 5002 for defining winding section 5005 together with the sidewalls 5002 and the main body, and the plural partitions 5004 define a receiving portion 5006 therebetween. The receiving portion 5006 is partially communicated with the channel 5003 in order to receive parts of the secondary winding 502. The primary winding 501 of the present embodiment is preferred to be a conductive wire having at least a terminal 5010, wherein the primary winding 501 can be wound on the winding section 5005 of the bobbin 500 of the first magnetic device 50. As regards the secondary winding 502, it is preferably composed of plural conductive pieces. For example, the secondary winding 502 can be composed of three conductive pieces, each of which is formed by two conductive layers, such as copper layers, and an insulating layer disposed therebetween, but not limited thereto. Each of the conductive pieces has a conductive main body 5021, conductive pins 5022 extended from the conductive main body 5021, and a hole 5023. The configuration of the conductive main body 5021 of each conductive piece matches that of the cross section of the bobbin 500, and the hole 5023 of each conductive piece corresponded to the channel 5003 of the bobbin 500.

Please refer to FIG. 7 again. In this embodiment, the receiving chamber 504 of the first magnetic device 50 is disposed on one of the sidewalls 5002 of the bobbin 500, and the receiving chamber 504 is extended from the sidewall 5002 along the direction parallel to the axle of the main body of the bobbin 500. The shape of the receiving chamber 504 can be a semi-ellipse receptacle with volume substantially equal to the second magnetic device 51, so as to receive the second magnetic device 51 therein. Nevertheless, the shape of the receiving chamber 504 is not limited; in other words, rectangular receptacle, circular receptacle or receptacles with different shape but being available to receive the second magnetic device 51 therein can be applied as the receiving chamber 504. The receiving chamber 504 and the bobbin 500 are preferably to be integrally formed. In addition, the receiving chamber 504 further comprises a first through portion 5041 and at least a second through portion 5042, wherein the first and second through portions 5041 and 5042 can be circular through holes penetrating the bottom of the receiving chamber 504. The first through portion 5041 is corresponded to the central through hole 511 of the second magnetic device 51, and the number of the second through hole 5042 is not limited but preferred to be one. Hence the terminal 5010 of the primary winding 501 of the first magnetic device 50 and one of the conductive ends 512 of the second magnetic device 51 can pierce through the first and second through portions 5041 and 5042, respectively. Of course, in some embodiment, an additional second through portion 5042 can be disposed on the receiving chamber 504, and thus both of the two conductive ends 512 of the second magnetic device 51 can pierce through the second through portions 5042 and electrically connect to the system circuit board (not shown).

As illustrated in FIG. 7, while assembling the first magnetic device 50, the secondary winding 502 and the primary winding 501 are correspondingly disposed by turns. In other words, the conductive wires are wound on the winding sections 5005 of the bobbin 500 to serve as primary winding 501. The conductive pieces are served as the secondary winding 502, wherein the outmost conductive pieces are disposed at the opposite sides of the bobbin 500 and the conductive main body 5021 thereof are in contact with the sidewalls 5002 of the bobbin 500, and the conductive main body 5021 of the conductive piece at the middle is received in the receiving portion 5006 of the bobbin 500. Since the hole 5023 of each conductive piece served as secondary winding 502 is corresponded to the channel 5003 of the bobbin 500, the first magnetic portion 5031 of the magnetic core assembly 503 can be received in the channel 5003 of the bobbin 500 and each hole 5023 of the secondary winding 502. Therefore, the first magnetic portion 5031 is covered by the primary winding 501 and the secondary winding 502, and parts of the primary and secondary winding 501 and 502 can be covered by the second magnetic portion 5032 of the magnetic core assembly 503, so as to form the first magnetic device 50.

While assembling the second magnetic device 51 and the first magnetic device 50 as the integrated magnetic device 5, the second magnetic device 51 is received in the receiving chamber 504 disposed on the sidewall 5002 of the bobbin 500 of the first magnetic device 50. Since the central through hole 511 of the second magnetic device 51 is corresponded to the first through portion 5041 of the receiving chamber 504, the terminal 5010 of the primary winding 501 of the first magnetic device 50 can pierce through the central through hole 511 of the second magnetic device 51 and the first through portion 5041 of the receiving chamber 504 successively and electrically connect to the predetermined position on the system circuit board (not shown) directly. One of the conductive ends 512 of the second magnetic device 51 can pierce through the second through portion 5042 of the receiving chamber 504 and electrically connect to the system circuit board as well. The integrated magnetic device 5 can be disposed on the system circuit board via the conductive pins 5022 of the secondary winding 502 of the first magnetic device 50 protruded relative from the bobbin 500. The other terminal (not shown) of the primary winding 501 of the first magnetic device 50 and the conductive end 512 of the second magnetic device 51 not being received in the second through portion 5042 of the receiving chamber 504 can be directly soldered to the predetermined position on the system circuit board as well. Therefore, the integrated magnetic device 5 is electrically connected to the system circuit board (not shown). While the current input from the system circuit board is received by the primary winding 501 of the first magnetic device 50, the inductive current is generated by the secondary winding 502 and transferred to the load (not shown) correspondingly. The current of the first magnetic device 50 can be measured by the second magnetic device 51 owing to the terminal 5010 of the primary winding 501 piercing through the central through hole 511 of the second magnetic device 51.

According to the forgoing embodiments, it is to be understood that the second magnetic device can be received in the receiving chamber disposed on the bobbin of the first magnetic device, so as to integrate the first and second magnetic devices as an integrated magnetic device. Therefore, the space utility of the system circuit board can be raised. In addition, since the terminal of the primary winding of the first magnetic device pierces through the central through hole of the second magnetic device and electrically connected to the system circuit board directly, the power loss can be avoided. Moreover, no matter the receiving chamber is disposed on the first extension portion of the bobbin (as shown in FIG. 5), the second extension portion of the bobbin (as shown in FIG. 6), or the sidewall of the bobbin (as shown in FIG. 7), the purpose for integrating the first and second magnetic devices and preventing the power loss will not be impacted.

Figure 8:
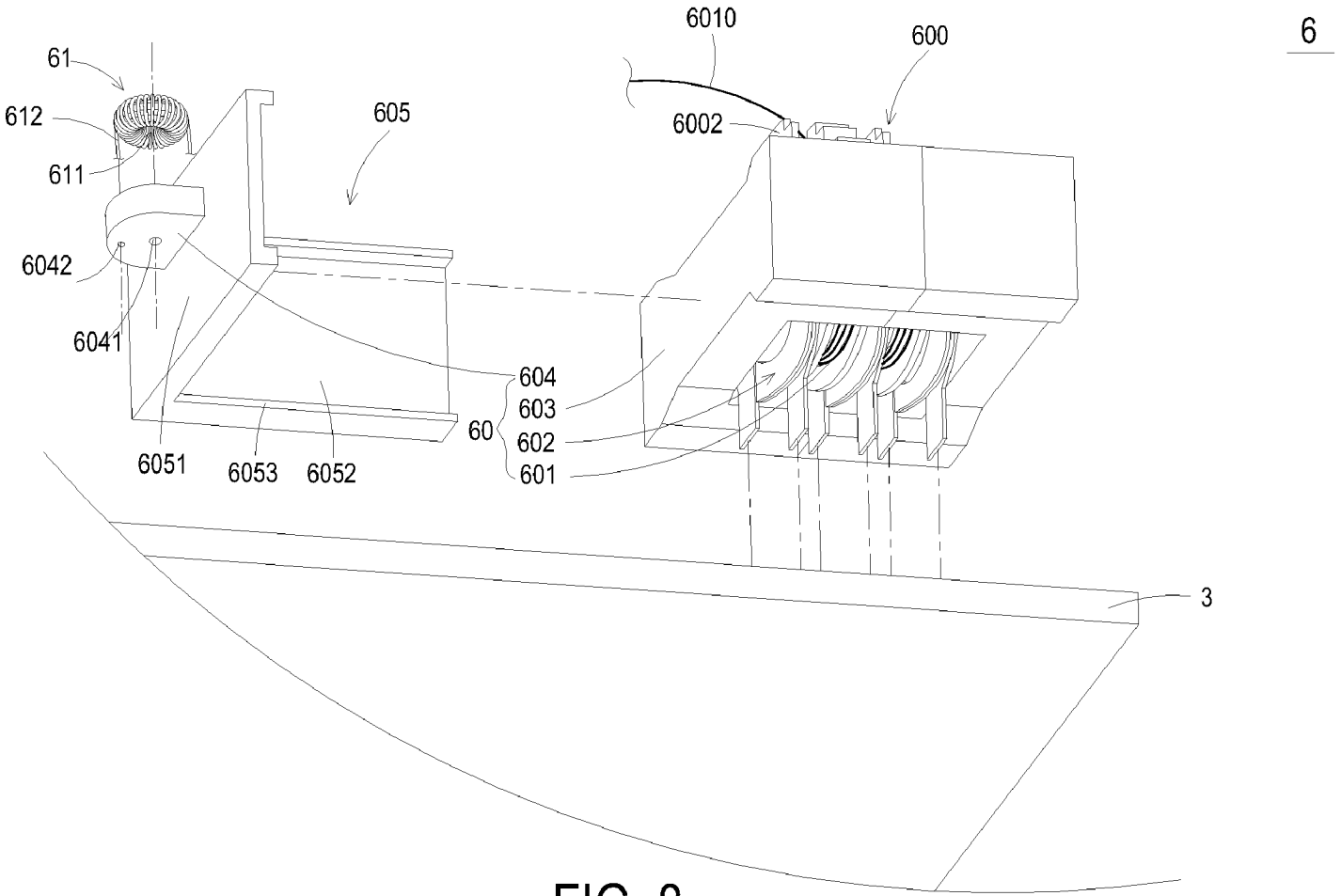
FIG. 8 is a schematic diagram showing the structure of the integrated magnetic device according to the fourth preferred embodiment of the present invention.
Figure 9:
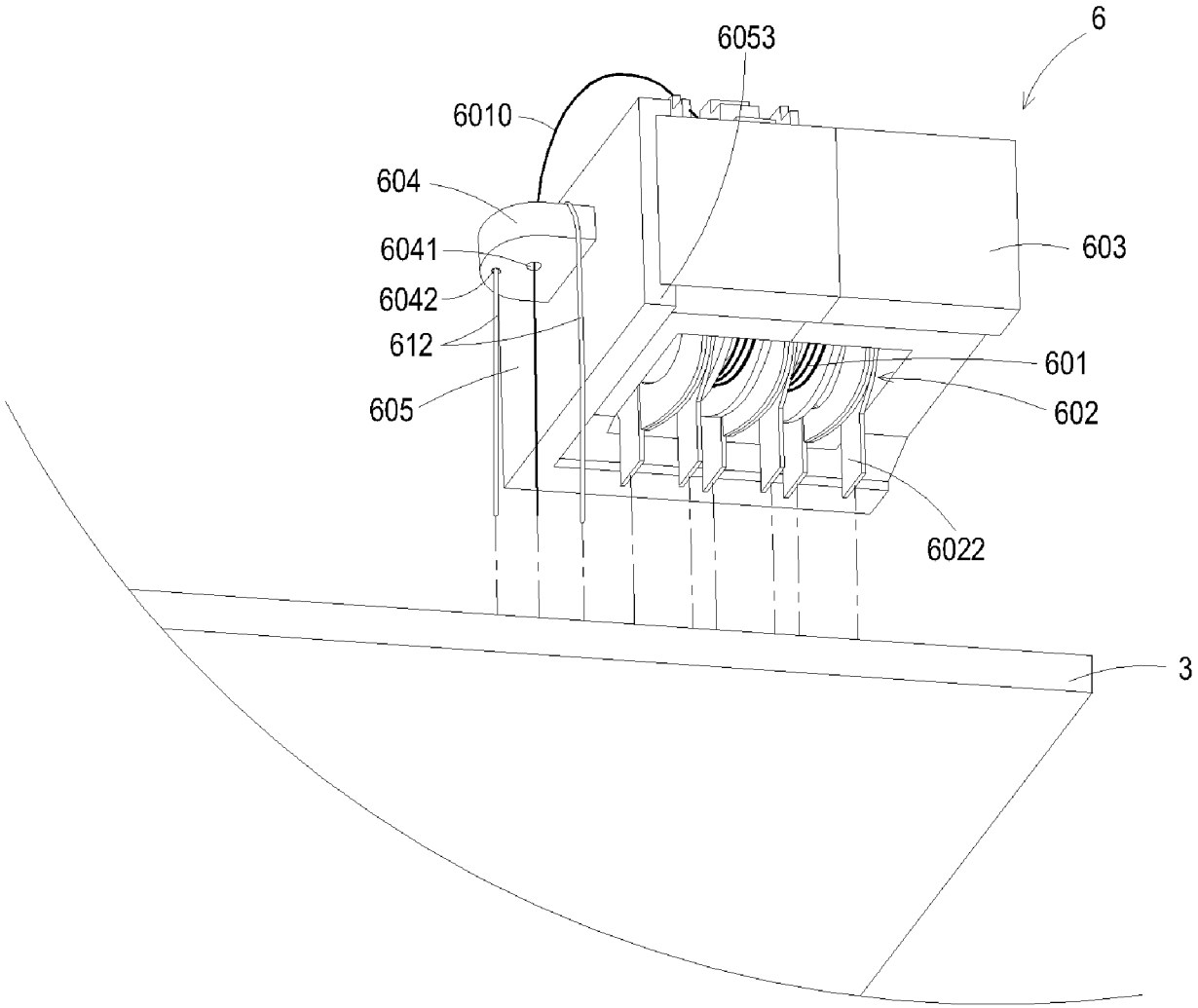
FIG. 9 is a schematic diagram showing the integrated magnetic device of FIG. 8 being disposed on the system circuit board.

FIG. 8 is a schematic diagram showing the structure of the integrated magnetic device according to the fourth preferred embodiment of the present invention. As shown in FIG. 8, the integrated magnetic device 6 comprises a first magnetic device 60 and a second magnetic device 61. The first magnetic device 60 is a transformer, and the structure thereof is substantially similar to that of the first magnetic device 50 shown in FIG. 7. In other words, the first magnetic device 60 comprises a primary winding 601, a second winding 602, a magnetic core assembly 603, a receiving chamber 604, and a bobbin 600, wherein the relationship among these structures are the same as that of the third preferred embodiment shown in FIG, 7, and thus it is not redundantly described. The structure of the bobbin 600 is similar to the bobbin 500 depicted in FIG. 7, except the receiving chamber 604. In this embodiment, the first magnetic device 60 further comprises a cover 605, and the receiving chamber 604 is not disposed on the sidewall 6002 of the bobbin 600 but disposed on the cover 605 in comparison with the structure shown in FIG. 7. The cover 605 is composed of insulating material, such as plastic, and comprises a first side 6051, a second side 6052, and the rib 6053 extended from the first side 6051 and the second side 6052. The cover 605 is disposed on the magnetic core assembly 603 by the rib 6053 engaging with the magnetic core assembly 603 (as shown in FIG. 9). Through installation of the cover 605, the electronic security between the integrated magnetic device 6 and the nearby electronic device with larger voltage difference (not shown) can be maintained.

Please refer to FIG. 8, the receiving chamber 604 can be extended from the first side 6051 of the cover 605, but not limited thereto. In other embodiments, the receiving chamber 604 can be disposed on the second side 6052 of the cover 605. The cover 605 and the receiving chamber 604 are preferred to be integrally formed. The receiving chamber 604 comprises a first through portion 6041 and at least a second through portion 6042, wherein the functions and the structures of the receiving chamber 604 and the first and second through portions 6041, 6042 thereof are the same as that of the third preferred embodiment shown in FIG. 7. While integrating the second magnetic device 61 with the first magnetic device 60, the second magnetic device 61 is received in the receiving chamber 604 disposed on the cover 605 of the first magnetic device 60. Since the central through hole 611 of the second magnetic device 61 is corresponded to the first through portion 6041 of the receiving chamber 604, the terminal 6010 of the primary winding 601 of the first magnetic device 60 can pierce through the central through hole 611 of the second magnetic device 61 and the first through portion 6041 of the receiving chamber 604 successively. One of the conductive ends 612 of the second magnetic device 61 can pierce through the second through portion 6042 and being partially received therein, so as to position the conductive end 612 relative to the receiving chamber 604 by the second through portion 6042. Accordingly, the first and second magnetic devices 60 and 61 can be integrated as the single integrated magnetic device 6 by the cover 605 and the receiving chamber 604 disposed on thereon (as shown in FIG. 9). The integrated magnetic device 6 can be disposed on the predetermined position of the system circuit board 3 through the conductive pins 6022 of the secondary winding 602 of the first magnetic device 60, so as to structurally and electrically connect to the system circuit board 3. Of course, the terminal 6010 of the primary winding 601 of the first magnetic device 60 and the conductive end 612 of the second magnetic device 61 that pierce through the second through portion 6042 can be pulled toward the system circuit board 3 and electrically connected to the system circuit board 3. As the other terminal (not shown) of the primary winding 601 of the first magnetic device 60 not being disposed in the first through portion 6041 and the other conductive end 612 of the second magnetic device 61 not being disposed in the second through portion 6042 can be electrically connect to the system circuit board 3 as well, so as to dispose the integrated magnetic device 6 on the system circuit board 3 (as shown in FIG. 9).

According to the foregoing description, it is to be understood that the receiving chamber for receiving the second magnetic device not only can be disposed on the bobbin of the first magnetic device (as shown in FIGS. 5-7) but also can be disposed on the cover 605 of the first magnetic device 60 (as shown in FIG. 8), the purpose for integrating the first and second magnetic devices 60 and 61 will not be impacted. Therefore, while the concept of the present invention is applied to the first magnetic device without bobbin, the first and second magnetic devices can be integrated by receiving the second magnetic device in the receiving chamber disposed on the cover assembled with the magnetic core assembly, so as to raise the space utility of the system circuit board and avoid the power loss caused by conventional technique of connecting the first and second magnetic devices through the trace of the system circuit board. Moreover, when the integrated magnetic device is disposed on the system circuit board, the electronic security between the integrated magnetic device and the electronic devices adjacent thereto can be ensured via the installation of the cover.

To sum up, in the present invention, the first and the second magnetic devices are integrated as an integrated magnetic device by receiving the second magnetic device in a receiving chamber disposed on the unoccupied space of the bobbin or the cover of the first magnetic device. Since the second magnetic device is disposed on the first magnetic device, the space of the system circuit board will not be occupied by the second magnetic device. Therefore, the space utility of the system circuit board can be raised, and the trend for minimizing the volume of the system circuit board and the electronic equipment can be matched.

In addition, since the terminal of the primary winding of the first magnetic device of the integrated magnetic device can pierce through the central through hole of the second magnetic device and electrically connect to the system circuit board directly, the process for assembling the first and second magnetic devices on the system circuit board can be simplified. Of course, the power loss and the inconvenience cause by connecting the transformer and conductive wire piercing through the central through hole of the current sensor via the trace of the system circuit board in the conventional technique can be prevented. Thus the efficiency of the integrated magnetic device can be raised.

Moreover, because the receiving chamber of the first magnetic device can be disposed on the bobbin or the cover of the first magnetic device according to different requirements, the structure of the integrated magnetic device is diversified, and the design and disposition of the system circuit board are flexible.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An integrated magnetic device being disposed on a system circuit board, said integrated magnetic device comprising:

a first magnetic device comprising:

a primary winding having at least a terminal;

a secondary winding disposed corresponding to said primary winding;

a magnetic core assembly assembled with said primary winding and said secondary winding and partially covered by said primary winding and said secondary winding;

a cover disposed on said magnetic core assembly;

a receiving chamber disposed on said cover; and a bobbin, said bobbin comprising:

a main body having a sidewall at opposite side thereof;

a channel penetrating through said sidewall and said main body, so as to receive part of said magnetic core assembly; and a winding section, wherein said primary winding is disposed on said winding section; and a second magnetic device having a central through hole and a plurality of conductive ends, said second magnetic device being received in said receiving chamber of said first magnetic device and electrically connected to said system circuit board via said conductive ends, and said terminal of said primary winding of said first magnetic device piercing through said central through hole of said second magnetic device and being electrically connected to said system circuit board.

2. The integrated magnetic device according to claim 1, wherein a winding section is defined by said main body and said sidewall of said bobbin of said first magnetic device, and said primary winding and said secondary winding are conductive wires disposed on said winding section.

3. The integrated magnetic device according to claim 1, wherein said bobbin of said first magnetic device further comprises a first extension portion, said first extension portion being extended from said sidewall and having a plurality of conductive pins disposed thereon, so as to dispose said integrated magnetic device on said system circuit board via said conductive pins.

4. The integrated magnetic device according to claim 3, wherein said bobbin of said first magnetic device further comprises a second extension portion, said second extension portion being extended from said sidewall and opposite to said first extension portion.

5. The integrated magnetic device according to claim 1, wherein said bobbin of said first magnetic device further comprises a plurality of partitions disposed on said main body, said winding section is defined by said partitions, said sidewall and said main body, and a receiving portion is defined by said partitions and partially communicated with said channel.

6. The integrated magnetic device according to claim 5, wherein said primary winding of said first magnetic device is conductive wire disposed on said winding section of said bobbin, said secondary winding is a plurality of conductive pieces being disposed at the opposite sides of said bobbin and received in said receiving portion, so as to dispose said integrated magnetic device on said system circuit board through said secondary winding.

7. The integrated magnetic device according to claim 1, wherein said receiving chamber of said first magnetic device further comprises:

a first through portion corresponded to said central through hole of said second magnetic device, said terminal of said primary winding piercing through said central through hole of said second magnetic device and said first through portion and electrically connecting to said system circuit board; and at least a second through portion, said conductive ends of said second magnetic device piercing through said second through portion and electrically connecting to said system circuit board.

8. The integrated magnetic device according to claim 1, wherein said magnetic core assembly comprises a first magnetic portion and a second magnetic portion, said first magnetic portion is received in said channel of said bobbin of said first magnetic device, and said second magnetic portion is covered on said primary winding and said secondary winding.

9. The integrated magnetic device according to claim 1, wherein said first magnetic device is a transformer.

10. The integrated magnetic device according to claim 1, wherein said second magnetic device is a current sensor.

* * * * *